United States Patent [19]

Cetnar

[11] Patent Number: 5,015,505

[45] Date of Patent: May 14, 1991

[54] METHOD AND APPARATUS FOR STRIPING A TIRE SIDEWALL

[75] Inventor: James F. Cetnar, Akron, Ohio

[73] Assignee: Bridgestone/Firestone, Inc., Akron, Ohio

[21] Appl. No.: 411,980

[22] Filed: Sep. 25, 1989

[51] Int. Cl.[5] ..... B05D 5/00; B05D 1/26; B05C 3/20; B05C 11/10

[52] U.S. Cl. ..... 427/286; 118/409; 118/410; 118/415; 118/681; 118/682; 118/703; 118/712

[58] Field of Search ..... 118/107, 409, 410, 682, 118/415, 703, 681, 712; 156/116; 427/286

[56] References Cited

U.S. PATENT DOCUMENTS 2,355,382 8/1944 Leguillon ..... 118/682
4,177,233 12/1979 Roberts, Jr. ..... 118/408 X

*Primary Examiner*—Evan Lawrence
*Attorney, Agent, or Firm*—Daniel N. Hall

[57] ABSTRACT

A method and apparatus for imparting a decorative strip onto the sidewall of a cured tire. The tire is sealed between a pair of chucks and inflated. The sidewall portion of the tire to be decorated is maintained in a flat horizontal posture by the chucks and the inflation pressure. The tire is then rotated while a gun, having a nib is contact with the tire sidewall, dispenses a paint directly onto the tire. A heating element for curing or partially curing the paint is maintained in juxtaposition to the sidewall for heating the paint strip as it passes thereunder.

13 Claims, 1 Drawing Sheet

METHOD AND APPARATUS FOR STRIPING A TIRE SIDEWALL

TECHNICAL FIELD

The invention herein resides in the art of pneumatic tire construction and, more particularly, to the application of decorative features to the sidewall thereof. Specifically, the invention relates to a method and apparatus for applying a decorative sidewall to a cured tire.

BACKGROUND ART

The provision of white or colored bands circumferentially about the sides of a pneumatic tire is well known. Such "white sidewall" tires are generally accepted as the mark of a premium tire and are often required to compliment the body features and styling of the car on which the tires are used.

There are various known methods for generating a "white wall" band on a tire. The basic prior art teaches the implementation of extruded inlays placed in the tire carcass during construction and later buffed to obtain a uniform exposure of the decorative sidewall band after the curing operation. Further, attempts at spraying, painting, or otherwise depositing such decorative strips have been known, but the prior art typically involves either (a) wrapping of a specially compounded white rubber onto an unvulcanized tire carcass during assembly of the carcass, or (b) masking and air spraying of paint onto a cured tire, or (c) pouring of paint into a groove purposefully imparted into the tire sidewall for purposes of containing such paint, or (d) rotating a paint dispensing head around a stationary tire.

Prior to the invention herein, it has been most desirable to provide for the decoration of a tire sidewall without (a) the cost and complexity inherent in the extrusion of specially compounded rubber inlays, (b) the time and cost associated with the masking and mask cleaning in spraying operations, (c) the need for provision of sidewall groves to retain paint therein, (d) rotation of the dispensing device itself about a stationary tire, and (e) waste resulting from over spraying.

SUMMARY OF THE INVENTION

In light of the foregoing, it is a first aspect of the invention to provide a method and apparatus for striping a tire sidewall which does not require special rubber compounds.

Another aspect of the invention is the provision of a method and apparatus for striping a tire sidewall in which no maskings of the tire is required.

Yet a further aspect of the invention is the provision of a method and apparatus for striping a tire sidewall in which there is no need for grooving the tire sidewall to define the boundaries of the decorative strip.

An additional aspect of the invention is the provision of a method and apparatus for striping a tire sidewall in which there is no need for rotating the dispensing device.

Yet a further aspect of the invention is the provision of a method and apparatus for striping a tire sidewall in which waste is substantially eliminated.

The foregoing and other aspects of the invention which will become apparant as the detailed description proceeds are achieved by an apparatus for applying a decorative strip to the sidewall of a tire, comprising: first means for engaging the tire and sealing an inner cavity thereof; second means in communication with the tire for inflating the tire by pressurizing said cavity; third means for rotating the tire about a central axis of the tire; and paint striping means in juxtaposition to the tire for maintaining a fixed position relative to the rotating tire and depositing paint on the tire sidewall as it rotates past said paint striping means.

Other aspects of the invention which will become apparent herein are attained by a process for applying a decorative strip to the sidewall of a tire, comprising: securing a tire to seal an inner cavity thereof; inflating said tire to a predetermined pressure; rotating said tire about a tire axis; and dispensing paint upon a sidewall of said tire during said rotation from a fixed position relative to said tire.

BRIEF DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
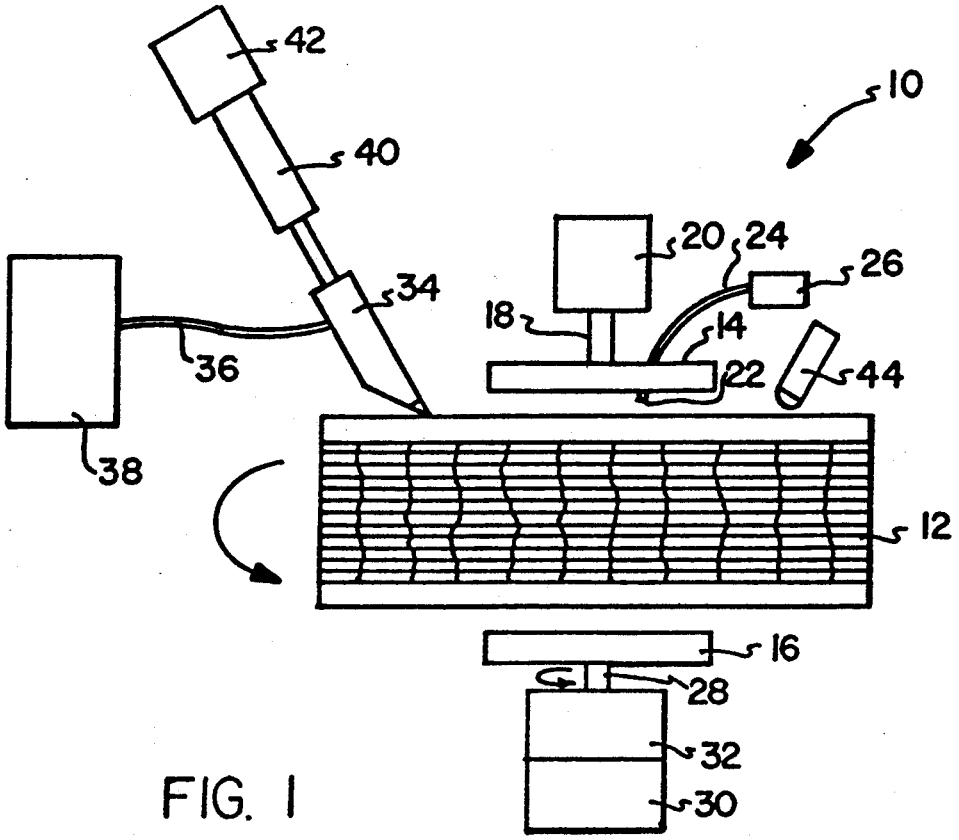
FIG. 1 is an illustrative view of a tire striping system according to the invention.

Referring now to the drawing and more particularly FIG. 1, it can be seen that a tire striping system according to the invention is designated generally by the numeral 10. The system 10 is adapted for applying a decorative concentric strip upon the sidewall of the tire 12, with the circular strip having a center at the tire axis. It will be appreciated that the tire 12 is a cured tire and that no groove is provided in the sidewall for purposes of defining the boundaries of the decorative strip as previously required by certain of the prior art.

The tire 12 is positioned between an upper bead chuck 14 and a lower bead chuck 16 adapted to engage the beads of the tire for sealing engagement therewith, thereby sealing the inner tire cavity. A piston 18, driven by a pneumatic pressure source or motor 20 is connected to the upper bead chuck 14 for reciprocating movement into and out of engagement with the upper tire bead to obtain the desired seal. An air nozzle 22 extends from the chuck 14 and communicates through a hose 24 with a source of air pressure 26. The assembly 22–26 is operative to inflate the tire 12 and seal it between the chucks 14,16. It will also be appreciated that the air pressure source 26 includes a pressure sensor for monitoring the inflation pressure of the tire 12 such that the inflation thereof may be terminated at a set level.

A piston 28 is connected to the lower bead chuck 16 and driven by a pneumatic pressure source or motor 30 into and out of engagement with the lower bead of the tire 12 to make or break a seal thereat. Typically, the reciprocating movement of the chucks 14,16 may be concurrent and, in any event, the chucks 14,16 could be driven off of the same pneumatic pressure source. It will, of course, be understood that the lower bead chuck 16 may be vertically fixed such that sealing engagement is achieved and broken by reciprocation of the upper bead chuck 14 through the piston 18 and pressure source 20. In such a structure, the reciprocating piston 28 and pressure source 30 may be eliminated.

A motor 32 is connected to the piston shaft 28 to rotate the shaft about its longitudinal axis and, through engagement of the chuck 16 with the lower bead of the tire 12, cause the tire 12 to rotate about a vertical axis while the region of the upper tire sidewall, to which a decorative strip is to be applied, lies in a horizontal plane. A paint stripe gun and associated nib 34 communicate through a hose 36 to a pressurized source of paint 38. The gun and nib 34 are interconnected by an extendable piston 40 which is controlled by a pneumatic or hydraulic motor 42 for extension and retraction. The piston and motor assembly 40, 42 is operative for extending the striping gun and nib 34 into contacting engagement with the sidewall of the tire 12 which is to be decorated. Paint is then dispensed under pressure from the source 38 through the hose 36 and nib of the gun 34, such paint being laid upon the tire sidewall surface while it rotates. With the gun 34 being held in a fixed position, and with the tire 12 rotating about the axis of its annulus, the result is a perfectly round ring of paint having a center corresponding to the center of the tire annulus, and a width determined by the width of the gun nib 34.

Also maintained in juxtaposition to the sidewall of the tire is a heat source such as a lamp, heating coils, blower or the like which serves to cure or set the paint defining the decorative strip as it passes thereunder.

Figure 2:
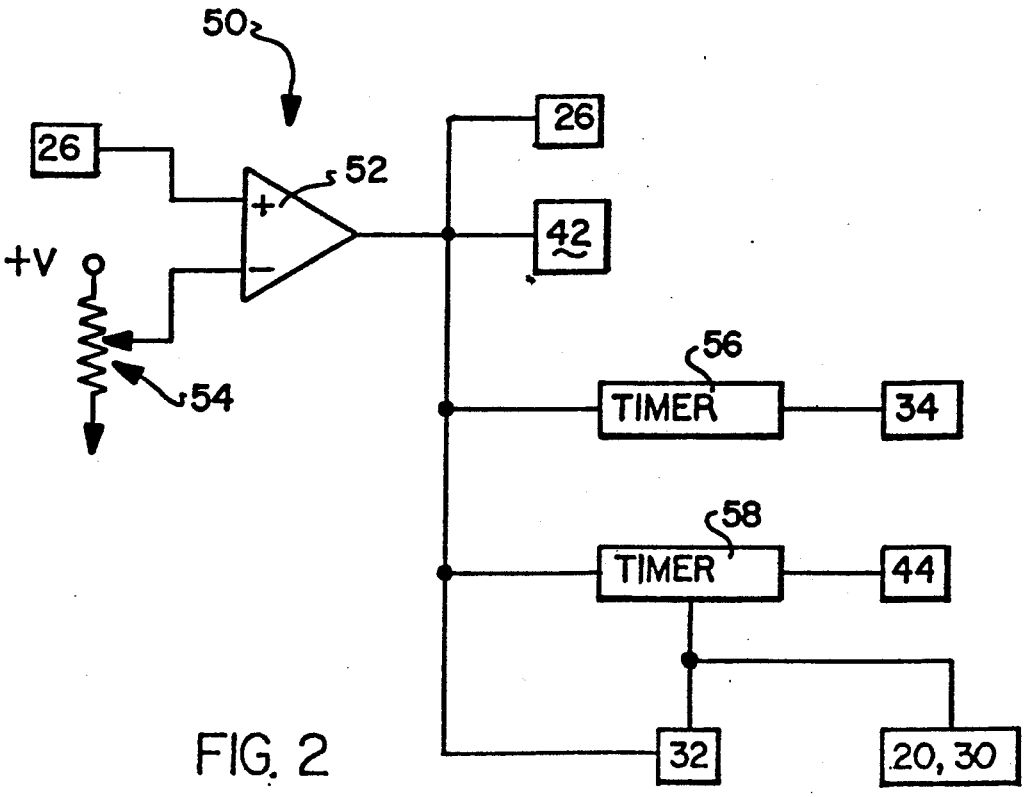
FIG. 2 is a schematic of the control circuit for effecting the striping process of the invention with the system of FIG. 1.

As shown in FIG. 2, the control circuit 50 may serve to regulate and control the operation of the structure of FIG. 1. As presented, a comparator 52 has the negative input thereof connected to a voltage divider 54 which establishes a threshold for the inflation level of the tire 12 to be obtained for the striping process. The positive input of the comparator 52 is connected to the air pressure source 26 which, as discussed above, includes a pressure sensor for monitoring the tire pressure. When the tire pressure reaches the threshold set by the voltage divider 54, the comparator 52 emits a positive output signal which is passed to and initates various elements connected to the output thereof.

As shown, as soon as the tire 12 is brought to the desired pressure, inflation is terminated by closing the valve at the air pressure source 26. At the same time, the pneumatic or hydraulic motor 42 is actuated to extend the piston 40 to bring the striping gun 34 into juxtaposition with the sidewall of the tire 12 such that the nib thereof makes contacting engagement with the sidewall. At such a point of contacting engagement, determined by a limit switch or other appropriate means, extension of the piston 40 is terminated. Of course the stroke of the piston itself may be set for such purpose.

The output of the comparator 52 also activates the motor 32 which begins to rotate the tire 12. At the same time, a timer 56 is initiated such that, after a set period of time sufficient to allow the nib of the gun 34 to contact the tire and to allow the motor 32 to reach a set steady rotational speed, the gun 34 is activated to allow paint from the source 38 to be dispensed therefrom. Knowing the rotational speed of the tire, the timer 56 allows the gun 34 to be activated for a sufficient period of time for one complete revolution of the tire such that a complete circular strip of paint is laid upon the sidewall surface. The timer 56 compensates for response times of the gun 34 for both turning on and turning off. If the lag time for turn-on and shut-down of the gun 34 are the same, the timer simply allows the gun 34 to be activated for a period of time corresponding to one revolution of the tire 12. If, however, such lag times differ, compensation is made by the timing of the timer 56. It will, of course, be appreciated that such lag times are dependent not only upon the mechanism 34 itself, but also upon the viscosity of the paint and the pressure under which it is dispensed.

It will also be appreciated that other structures and techniques for actuating and terminating the flow of paint from the gun 34 may be employed. For instance, a timing mark or lug on either of the rotating chucks 14, 16 can be positioned to engage a limit switch, indicating commencement and termination of a revolution. Similarly, a light source and photodetector may be positioned adjacent the area to be striped such that light reflected from the leading edge of the paint stripe and sensed by the photodetector can serve as a timing signal for controlling termination of paint flow.

The output of the comparator 52 also activates a timer 58 which establishes a cure cycle for activation of the heating element 44. Preferably, the timer 58 includes a delay such that the heating element 44 is activated at the appropriate time. In one embodiment of the invention, activation of the heating element 44 is delayed until a sufficient time after the depositing of the strip has passed to assure that the solvents of the paint have evolved. Typically, the delay of the timer 58 will be a function of the paint composition and rotational parameters of the tire. Preferably, the timer 58 allows the heating element 54 to remain on for a period of time equivalent to several revolutions of the tire 12. The heating element 44 provides for curing the paint or, at least, provides a partial or precure thereof. At the end of such time period, the timer 58 turns off the heating element 44, disengages or turns off the motor 32, and activates the pneumatic pressure sources 20,30 to release the chucks 14,16. The tire 12 is then removed and replaced with another such that the operation can begin anew.

Several specifics for the preferred operation of the invention should be observed. The striping gun 34 is typically of the type having a spring-loaded nib, such spring urging the nib into constant contacting engagement with the sidewall of the tire 12 for smooth even dispensing of the paint. A suitable gun for such a purpose is the Model A-USBT automatic striping gun provided with a 0.5 inch wide by 0.015 inch high flat nib such as Model SNF manufactured by Paasche Airbrush Company of Chigago, Ill. It will, of course, be appreciated that various types of stripers and nibs may be employed to satisfy the concept of the invention. It is further presented that the nib preferably engages the tire 12 at an angle of 70°–85°, and preferably 80° as shown in the drawing, with the tire 12 rotating from left to right as shown. Finally, it will be appreciated that the striper guns of the type just described include actuation valves for commencing and terminating the dispensing operation.

It is preferred that the sidewall area of the tire to receive the paint strip be formed of a non-staining rubber stock so that the painted strip can remain unblemished. Prior to striping, the sidewall area is prepared by wiping it with a lint-free rympl cloth which has preferably been soaked in 1,1,1-trichloroethane (TCE) or other suitable cleaning solvent. The surface is then primed with a 2–4% solution of 1, 3, 5-trichloro-s-triazine-2, 4, 6-trione in 50/50 ethyl acetate/TCE by means of a dispensing brush or other suitable applicator held against the rotating tire. Such application is preferably automatically positioned and actuated, as is the subsequent activation of the heating element 44 for approximately one minute to dry the primer.

The paint employed for the striping process of the invention is preferably a polyurethane paint which is highly flexible and highly durable. The polyurethane polymer in the paint is made using a polycaprolactone prepolymer of saturated diisocyanate such as $H_{12}MDI$ (hydrogenated diphenyl diisocyanate). The prepolymer is cured with a diol or polyol such as butanediol, trimethylolpropane, proparediol, or the like. In a preferred embodiment of the invention, a catalyst such as 10% dibutyl tin diacetate solution in MEK/XYLENE, is added to the paint. Preferably, catalyst is added in the range of 1–5 percent, and preferably 2–4 percent by weight of paint component.

Of particular importance in the selection of the paint is the viscosity thereof. Most preferably, viscosity of the paint is 40-370 centipoise. Such a viscosity is necessary so that the paint does not flow or creep after it is laid down upon the tire surface from the gun 34, but maintains the definition established as it is extruded under force from the nib of the gun 34.

In order to maintain the desired viscosity, a reducer or thinner must be added to the paint. It has been found that a thinner comprised of solvents such as n-butylacetate, ethyl benzene, propylene glycol methyl ether acetate, dipropylene glycol methyl ether, and others may be added in sufficient quantities to obtain the desired viscosity of 40-370 centipoise. Employing the paint with such a viscosity, it has been found that a low pressure head may be utilized in the pressurized paint source 38 to provide the smooth flow desired for obtaining the uniformly decorated sidewall. It has been found that head pressures of less than 7 psi and preferably on the order of 3–5 psi are sufficient for such purposes. Obviously, it is important that the pressure be maintained at a constant level just as it is desirable that the tire 12 be rotated at a constant speed. A synchronous motor has been found suitable for such purposes.

A key to the successful operation of the instant invention is to maintain the sidewall to be decorated in a flat, horizontal position. The chucks 14, 16 must be accurately and uniformly aligned and the tire 12 placed therein must be placed without skew. By properly chucking and inflating the tire, the sidewall surface to be decorated can be maintained flat and horizontal. Such a posture, attained by maintaining an appropriate separation distance between the tire beads and by inflating the tire to a particular pressure level, assists the paint laid upon the tire in maintaining a sharp definition as its boundaries, inhibiting flowing or creep which will tend to distort the decoration.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breath of the invention reference should be made to the following claims.

What is claimed is:

1. Apparatus for applying a decorative strip to the sidewall of a tire, comprising:

first means for engaging the tire and sealing an inner cavity thereof;

second means in communication with the tire for inflating the tire by pressurizing said cavity to an inflation pressure at which the sidewall portion for receiving the decorative strip is flat and horizontal;

third means for rotating the tire about a central axis of the tire;

paint striping means in juxtaposition to the tire and maintaining a fixed portion relative to the rotating tire for depositing paint having a viscosity of 40-370 centipoise onto said tire sidewall portion as it rotates past said paint striping means; and a source of paint in communication with said paint striping means and a means for pressurizing said source of paint to a pressure head of less than 7 psi.

2. The apparatus as recited in claim 1, wherein said first means engages opposite beads of the tire in spaced apart relation such that the sidewall thereof is horizontal and wherein said third means rotates the tire about a vertical axis passing through the center of the tire.

3. The apparatus as recited in claim 1, wherein said paint is a polyurethane paint.

4. The apparatus as recited in claim 1, further comprising means in communication with the tire for sensing pressure within said cavity of the tire.

5. The apparatus as recited in claim 4, further comprising control means connected to said third means and said striping means for activating said striping means at commencement of a revolution of the tire about said axis, and deactivating said striping means on conclusion of said revolution.

6. The apparatus as recited in claim 5, wherein said striping means is movably positioned with respect to the tire, said control means moving said striping means into said fixed position for depositing said paint, and removing said striping means from said fixed position on conclusion of said depositing of said paint.

7. The apparatus as recited in claim 6, further comprising heating means in juxtaposition to the rotating tire and controlled by said control means to heat and cure said paint deposited on the tire.

8. The apparatus as recited in claim 7, wherein said third means comprises a synchronous motor.

9. A process for applying a decorative strip to the sidewall of a tire, comprising:

securing a tire to seal an inner cavity thereof, said tire being secured at opposite beads, said beads being maintained in fixed spaced-apart relation to maintain the sidewall flat in the area thereof to receive the decorative strip;

inflating said tire to a predetermined pressure at which said sidewall is flat in said area thereof to receive the decorative strip;

rotating said tire about a tire axis;

dispensing paint upon a sidewall of said tire during said rotation from a fixed position relative to said tire; and wherein said step of dispensing paint comprises movement of a paint dispensing apparatus into contacting engagement with said area of said sidewall of said tire prior to dispensing paint, and removing said paint dispensing apparatus following said dispensing of paint, said apparatus contacting said area at an angle of 70°–85°.

10. The process as recited in claim 9, wherein said tire is rotated about a vertical axis, said sidewall lying in a horizontal plane.

11. The process as recited in claim 10, wherein said step of dispensing said paint commences at a time following commencement of said step of rotating said tire to assure that said tire is rotating at a constant speed.

12. The process as recited in claim 11, further comprising the step of heating said paint upon said sidewall following the application thereto, said heating curing said paint.

13. The process as recited in claim 12, wherein said rotating of said tire continues for a period of time following termination of said step of dispensing paint.

* * * * *